US011013086B2

(12) United States Patent
Morales

(10) Patent No.: US 11,013,086 B2
(45) Date of Patent: May 18, 2021

(54) METHODS AND APPARATUS FOR DELIVERY OF CONSTANT MAGNITUDE POWER TO LED STRINGS

(71) Applicant: ISINE INC., Melville, NY (US)

(72) Inventor: Louis J. Morales, Somerville, MA (US)

(73) Assignee: i Sine Inc., Melville, NY (US)

( * ) Notice: Subject to any disclaimer, the term of this patent is extended or adjusted under 35 U.S.C. 154(b) by 0 days.

(21) Appl. No.: 16/710,525

(22) Filed: Dec. 11, 2019

(65) Prior Publication Data

US 2020/0229280 A1 Jul. 16, 2020

Related U.S. Application Data

(60) Provisional application No. 62/778,878, filed on Dec. 12, 2018.

(51) Int. Cl.
*H05B 45/37* (2020.01)
*H05B 45/48* (2020.01)
*H05B 45/357* (2020.01)

(52) U.S. Cl.
CPC ..... *H05B 45/48* (2020.01); *H05B 45/357* (2020.01); *H05B 45/37* (2020.01)

(58) Field of Classification Search
None
See application file for complete search history.

(56) References Cited

U.S. PATENT DOCUMENTS

| | | | | |
|---|---|---|---|---|
| 9,451,663 | B2 * | 9/2016 | Jang | H05B 45/48 |
| 10,178,717 | B2 * | 1/2019 | Seyler | H05B 45/48 |
| 2011/0186874 | A1 * | 8/2011 | Shum | H01L 25/0753 257/88 |
| 2013/0313984 | A1 * | 11/2013 | Maiwald | H05B 47/10 315/188 |
| 2015/0245427 | A1 * | 8/2015 | Jung | H05B 45/48 315/193 |
| 2015/0305098 | A1 * | 10/2015 | Jung | H05B 45/50 315/122 |
| 2016/0050731 | A1 * | 2/2016 | Jung | H05B 45/395 315/201 |

* cited by examiner

*Primary Examiner* — Anh Q Tran
(74) *Attorney, Agent, or Firm* — Raymond J. Werner

(57) ABSTRACT

In some embodiments, a driver circuit for a light emitting diode (LED) lightbulb having a plurality of series-coupled LED strings, includes a power supply circuit coupled to a first LED string of the plurality of LED strings, an energy storage circuit coupled to the power supply circuit, and a current steering circuit coupled to the power supply circuit and coupled to at least one LED string of the plurality of LED strings. Power delivered to the LED strings is the power from the power supply circuit, plus a discharge power from the energy storage circuit, minus power diverted from the power supply circuit and directed to the energy storage circuit. The energy storage circuit stores energy during a first portion of a rectified AC power waveform and provides power during a second portion of the rectified AC power waveform.

20 Claims, 11 Drawing Sheets

*Source: IESNA Lighting Handbook, 9th Edition*

METHODS AND APPARATUS FOR DELIVERY OF CONSTANT MAGNITUDE POWER TO LED STRINGS

CROSS-REFERENCE TO RELATED APPLICATIONS

This application claims the benefit of previously filed provisional application U.S. 62/778,878, filed 12 Dec. 2018, and entitled "Methods and Apparatus for Delivery of Constant Magnitude Power to LED Strings," the entirety of which is incorporated herein by reference.

FIELD

The present application relates to power deliver to LED strings.

BACKGROUND

Recently, there has been great interest in reducing the energy consumption of lighting sources, as well as in reducing the size and costs of the lighting sources while also increasing the lifetime of such products. Since it is well known that conventional incandescent light bulbs waste a significant amount of energy in the form of heat, alternatives to incandescent lighting are seen as a possible means of reducing energy consumption. Semiconductor-based lighting products are an alternative form of lighting.

A light-emitting diode (LED) is a well-known semiconductor device comprising a PN junction that emits light when forward-biased. Conventional control circuits for LED-based lighting products typically consist of two circuit portions. A first one of the two circuit portions is an AC-to-DC converter. In some instances these AC-to-DC converters include power factor correction circuitry. A second one of the two circuit portions is a current controller coupled to drive a plurality of LEDs in series, in parallel, or in both series and parallel, depending on the desired wattage, voltage, and/or light output. Conventional versions of these circuits require the presence of capacitors having high capacitance values. There are a number of different types of capacitor components, however, the most practical type of capacitors for the requirements mentioned above are electrolytic capacitors.

Unfortunately, incorporating electrolytic capacitors into these circuits limits the reliability of LED-based lighting products generally. In particular, electrolytic capacitors tend to be the electrical component that is among the first to fail in an LED-based lighting product.

SUMMARY

In some example embodiments, a rectified AC voltage may power one or more LED strings such that the LED strings consume a constant amount of power regardless of how many of the one or more LED strings are turned on. In one example embodiment, an electronic device is provided that includes a plurality of LED strings coupled to each other in series. Each LED string may have one or more LEDs therein. The electronic device may further include a first circuit configured to receive an AC power waveform and further configured to provide as an output a rectified AC power waveform. The first circuit may be, but is not limited to, a bridge rectifier. The electronic device may further include a second circuit, coupled to the first circuit, configured to receive a portion of the rectified AC power waveform from the first circuit responsive to the rectified AC power waveform being greater than the AC Average Power, and further configured to provide power responsive to the rectified AC power waveform being less than the AC Average Power. The term "AC Average Power," as used herein refers to the substantially constant power consumed in total by the plurality LED strings during the rectified AC power cycle. The electronic device may further include a third circuit having a plurality of current paths, the third circuit coupled to the first circuit, the second circuit, and the plurality of LED strings, wherein at least one LED string of the plurality of LED strings is coupled to the first circuit and the second circuit, and each current path of the third circuit is configured to have a conductivity state including at least one of an on-state and an off-state. The conductivity state, i.e., on or off, of each current path depends on how many of the serially-connected LED strings have turned on. The number of LED strings that have turned on depends on the magnitude of the rectified AC voltage. That is, initially the forward voltage of the first LED string is reached, but the forward voltage of the remaining LED strings has not. At this point a current flows through the first LED string and through a first current path of the third circuit. As the rectified AC voltage increases during the course of the AC power cycle, the forward voltage of the next sequentially connected LED string is reached, and current flows through that LED string. The current through the newly conducting LED string is detected by the third circuit which, responsive to the detection turns off the first current path and directs the current from the first and second LED strings through a second current path. This is repeated for each LED string as its forward voltage is reached.

In another example embodiment, an LED lightbulb is provided. In this example embodiment, the LED lightbulb includes a housing, at least a portion of which is optically transmissive, a screwbase coupled to the housing, and an electronic device disposed within the housing. In this example embodiment, the electronic device may include a plurality of LED strings coupled to each other in series. Each LED string may have one or more LEDs therein. The electronic device may further include a first circuit configured to receive an AC power waveform and further configured to provide as an output a rectified AC power waveform. The first circuit may be, but is not limited to, a bridge rectifier. The electronic device may further include a second circuit, coupled to the first circuit, configured to receive a portion of the rectified AC power waveform from the first circuit responsive to the rectified AC power waveform being greater than the AC Average Power, and further configured to provide power responsive to the rectified AC power waveform being less than the AC Average Power. The electronic device may further include a third circuit having a plurality of current paths, the third circuit coupled to the first circuit, the second circuit, and the plurality of LED strings, wherein at least one LED string of the plurality of LED strings is coupled to the first circuit and the second circuit, and each current path of the third circuit is configured to have a conductivity state including at least one of an on-state and an off-state.

In another example embodiment, a method of operating an LED light bulb is provided. In one embodiment, a method of operating an LED light bulb includes rectifying an AC mains voltage to produce a rectified AC voltage, directing a first amount of power, derived from the rectified AC voltage, to at least one of a plurality of serially-connected LED strings, directing a second amount of power, derived from the rectified AC voltage, to an energy storage circuit, and directing a third amount of power, derived from the energy storage circuit, to the at least one of the plurality of serially-connected LED strings, wherein the first amount of power is a first time-varying amount, the second amount of power is a second time-varying amount, and the third amount of power is a third time-varying amount. The second amount of power may be zero when the first amount of power is less than a predetermined magnitude, and the third amount of power may be zero when the first amount of power is greater than the predetermined magnitude. By directing power, derived from the rectified AC voltage, in excess of a predetermined amount to an energy storage circuit, and supplementing the power derived from the rectified AC voltage responsive to its being less than the predetermined amount, a substantially constant amount of power may be delivered to the plurality of LED strings.

Numerous other aspects are provided. Other features and aspects of the present disclosure will become more fully apparent from the following detailed description, the appended claims and the accompanying drawings.

BRIEF DESCRIPTION OF THE DRAWINGS

Aspects of the present disclosure are best understood from the following detailed description when read with the accompanying figures. It is noted that, in accordance with the common practice in the industry, various features may not be drawn to scale. In fact, the dimensions of the various features may be arbitrarily increased or reduced for clarity of discussion.

DETAILED DESCRIPTION

Various example embodiments herein relate to an AC LED driver circuit configured to drive a plurality of serially-connected LED strings without generating a DC voltage. As described in more detail below, various embodiments in accordance with this disclosure provide nominally constant power to the plurality of serially-connected LED strings derived from a rectified AC voltage rather than a DC voltage.

Conventional AC LED drivers for LED-based light bulbs incorporate electrolytic capacitors. Because electrolytic capacitors are often among the first components of an AC LED driver to fail, various example embodiments disclosed herein provide AC LED drivers that are free from electrolytic capacitors.

Various embodiments in accordance with the present disclosure, deliver power to the load, e.g., the LED strings of an LED light bulb, such that the power is nominally constant, during the operation of the LED light bulb. The term nominally constant refers to a value that is constant or that varies within a small predetermined range, such as ±2%, ±5% or ±10%, to provide some non-limiting examples. The nominally constant power delivered to the LED strings of an LED light bulb is referred to herein as the AC Average power. While the AC line power is in excess of the AC Average power, the AC line power is stored. And, while the AC line power is less than the AC Average power, an amount of the stored power (energy) is drawn to make up the difference. In some embodiments a capacitor is used for storage, while in other embodiments an inductor may be used for storage.

Light bulbs based on LEDs are commonly powered from an AC line, which is typically at voltages between 100 and 277 Volts Alternating Current ($V_{AC}$), and at nominal frequencies of 50 Hz or 60 Hz. Strings of LEDs are typically used in such light bulbs. Each such string is made up of a plurality of individual, serially-connected, LEDs.

Figure 1:
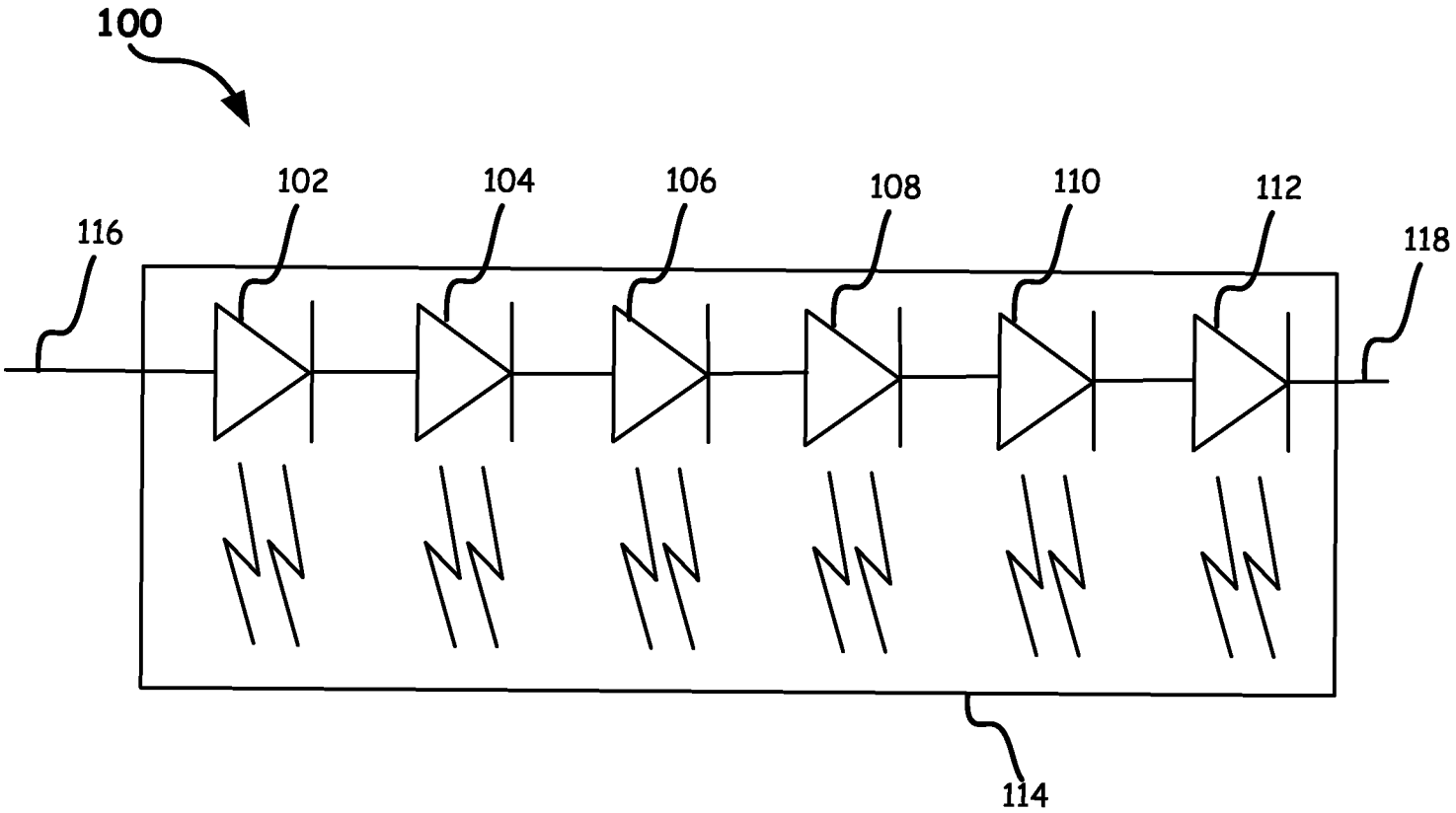
FIG. 1 illustrates a high-level circuit diagram of an LED string suitable for use in various example embodiments of an AC LED driver in accordance with embodiments of this disclosure.

FIG. 1 is a high-level circuit diagram of an example LED string 100 suitable for use in various embodiments in accordance with this disclosure. LED string 100 includes six serially coupled LEDs such that a first LED 102 is coupled in series with a second LED 104; second LED 104 is coupled in series with a third LED 106; third LED 106 is coupled in series with a fourth LED 108; fourth LED 108 is coupled in series with a fifth LED 110; and fifth LED 110 is coupled in series with a sixth LED 112. An LED string may have more or fewer LEDs than the six LEDs of example LED string 100. LEDs 102, 104, 106, 108, 110, and LED 112 of example LED string 100 may be disposed in or on a substrate 114, e.g., a package that provides a pathway for the light output of the LEDs. Example LED string 100 also includes an input terminal 116 coupled to the anode of first LED 102, and an output terminal 118 coupled to the cathode of sixth LED 112.

Although an LED light bulb is powered from the AC line, the LEDs themselves require direct current (DC). And, in order to avoid damage to the LEDs of the light bulb, the current supplied to the LEDs must not exceed the maximum DC current rating specified by the LED manufacturer. The voltage developed across an LED for a given current varies by a small but significant amount from one LED to another, and over time and temperature.

Figure 2:
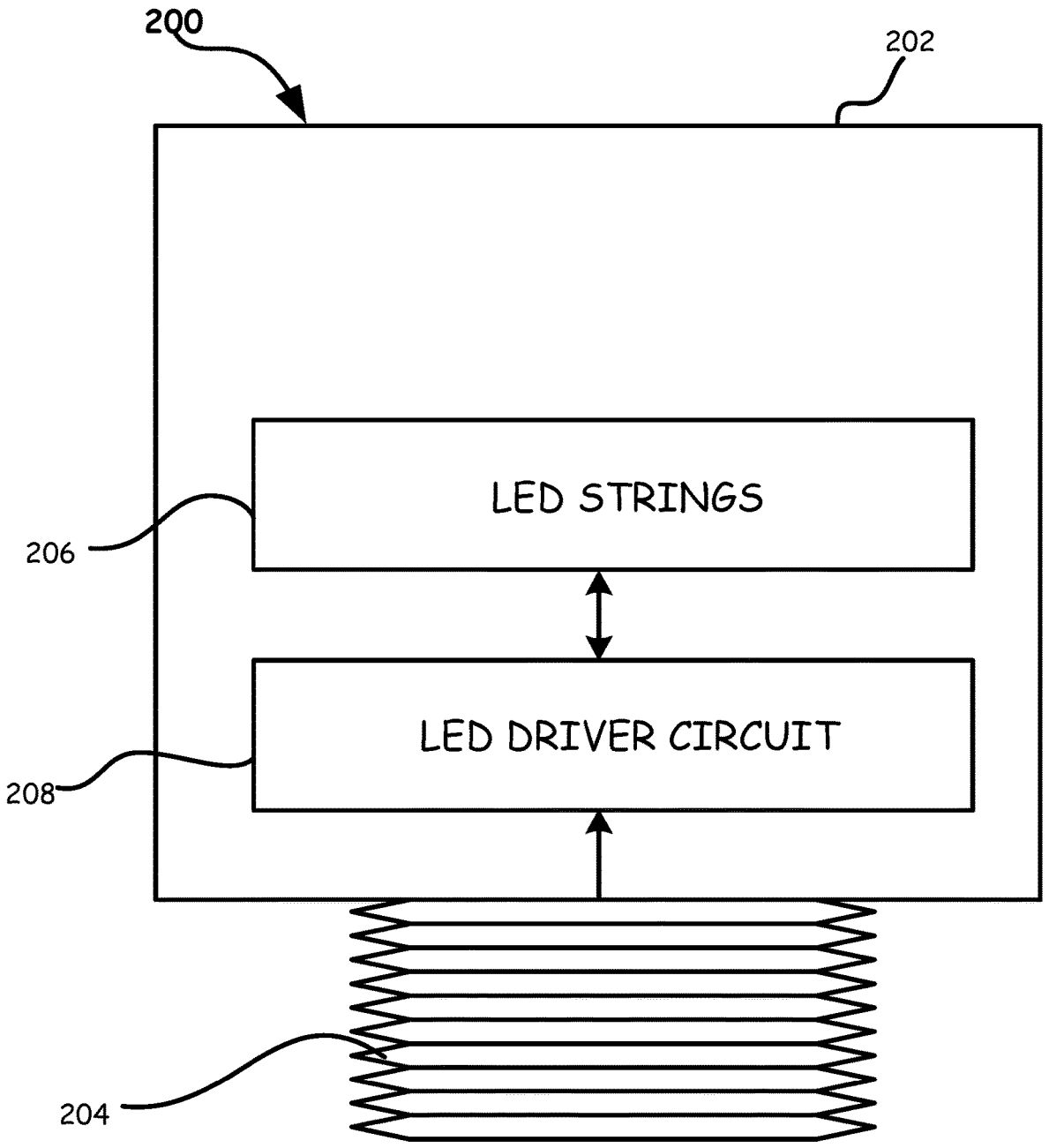
FIG. 2 illustrates a high-level block diagram of an example LED light bulb having a plurality of LED strings in accordance with embodiments of this disclosure.

FIG. 2 illustrates a high-level block diagram of an example LED light bulb 200. Example LED light bulb 200 includes a housing 202, and a screwbase 204 coupled to housing 202. Housing 202 may be optically transmissive, e.g., translucent or transparent. In some embodiments, only a portion of housing 202 is optically transmissive. The transmissive housing allows light generated in the light bulb to pass to the space outside of housing 202. Screwbase 204 may be configured to engage with a socket that provides a connection to the mains AC voltage, for example, a lightbulb socket. In some applications the socket provides a connection to the output of a dimmer circuit rather than a connection to the mains AC voltage. Such a socket may be of the type used for conventional incandescent light bulbs. A plurality of LED strings 206, and an LED driver circuit 208 are disposed within example LED light bulb 200. In operation, LED driver circuit 208 receives an AC voltage from the mains via screwbase 204, and provides power for driving the LED strings 206. In other arrangements, the output a dimmer circuit is provided to the screwbase, rather than the mains AC voltage. Connections other than a screwbase may be used to couple AC voltage to LED driver circuit 208.

Various embodiments in accordance with this disclosure provide a nominally constant LED power, without generating a DC voltage. This nominally constant LED power may be achieved in some embodiments by storing energy during a first portion of a mains AC cycle, and returning, as power, at least some of the stored energy during a second portion of the mains AC cycle. Some embodiments may use a capacitor to store a predetermined amount of charge at a predetermined voltage. Alternative embodiments may use an inductor for energy storage in the form of a magnetic field generated by a time-varying current driven through the inductor.

As noted above, the AC LED driver circuitry of various embodiments does not generate a DC voltage, but rather generates a rectified version of the mains AC voltage, which is then applied to various portions of the AC LED driver circuitry. In this context, it is possible to illustrate the operational relationship of various portions of the AC LED driver circuitry by considering each LED string as a resistive load, and, given the voltages of the rectified mains AC voltage, showing the time-varying power waveforms of each of those various portions of the circuitry.

Figure 3:
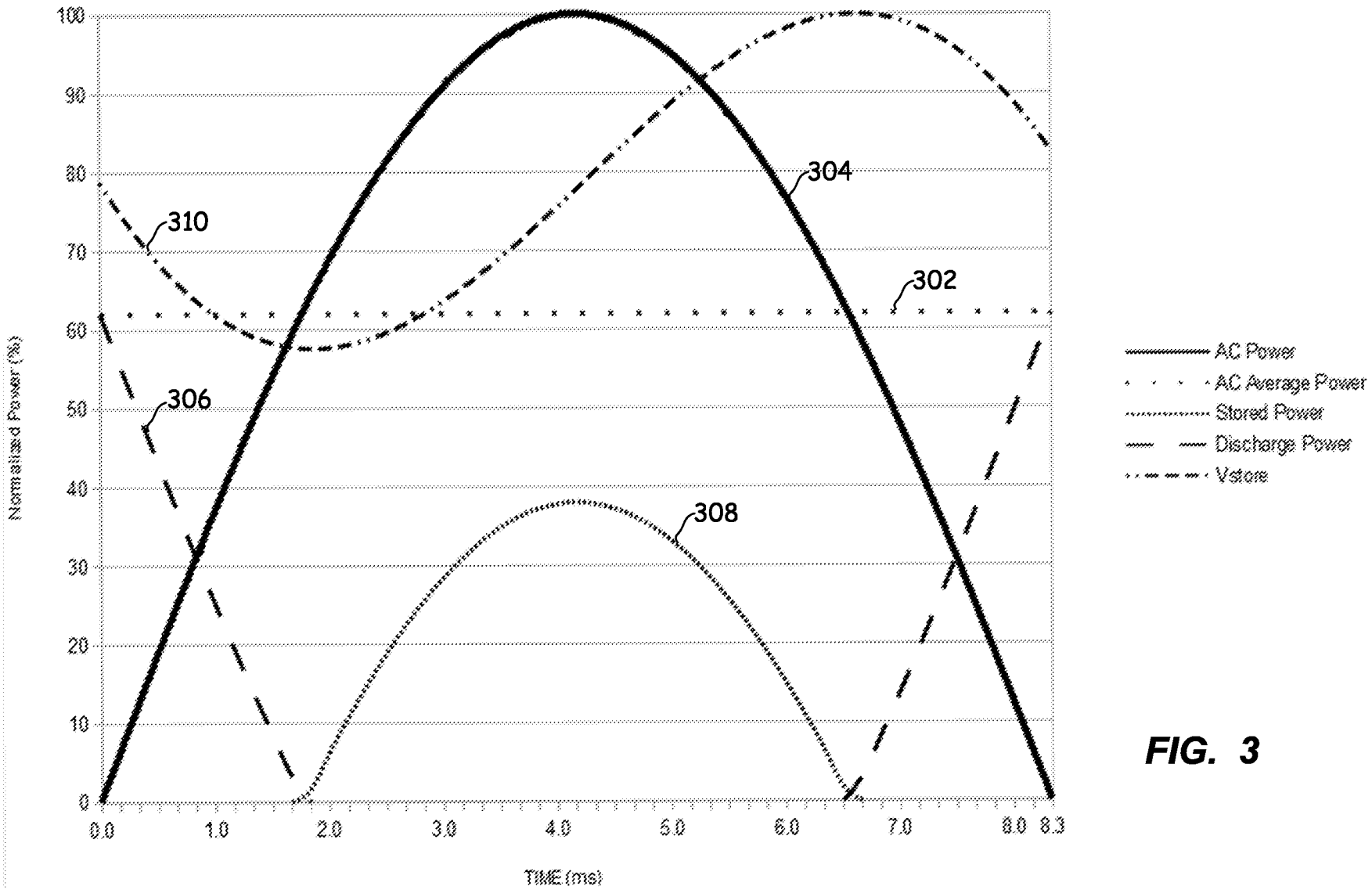
FIG. 3 illustrates a set of waveforms showing the relationship between AC Average power of serially connected LED strings, AC power, discharge power, stored power (energy), and stored voltage in accordance with embodiments of this disclosure.

FIG. 3 illustrates a set of waveforms showing the relationship between AC Average Power, AC Power, Discharge Power, Stored Power (energy), and Stored Voltage of various embodiments in accordance with this disclosure. As described in greater detail below, and with reference to FIG. 3, the AC Average Power is equal to ((AC Power−Stored Power)+Discharge Power). That is, when the AC Power is less than the AC Average Power, the Discharge Power, provided in this illustrative embodiment by an energy storage circuit, is used to supplement the AC Power; and when the AC Power is greater than the AC Average Power, the portion of the AC Power that is greater than the AC Average Power is directed to the energy storage circuit, thus maintaining the AC Average Power.

Still referring to FIG. 3, an AC Average Power waveform 302 shows a nominally constant, i.e., nominally time-invariant value. An AC Power waveform 304 shows the power delivered by a power supply circuit (not shown in this figure) during a half-cycle of an AC power cycle. A Discharge Power waveform 306 shows an amount of power supplied to the AC Average Power waveform 302 by an energy storage circuit (not shown in this figure), during the period of time that AC Power waveform 304 is below the AC Average Power waveform 302. A Stored Power waveform 308 shows the amount of power from AC Power waveform 304 that is diverted from AC Average Power waveform 302 and directed to the energy storage circuit. The charging and discharging of the energy storage circuit is further represented by Stored Voltage waveform 310. Stored Voltage waveform 310 shows the voltage on a capacitor used for energy storage in an illustrative embodiment in accordance with this disclosure.

Figure 4:
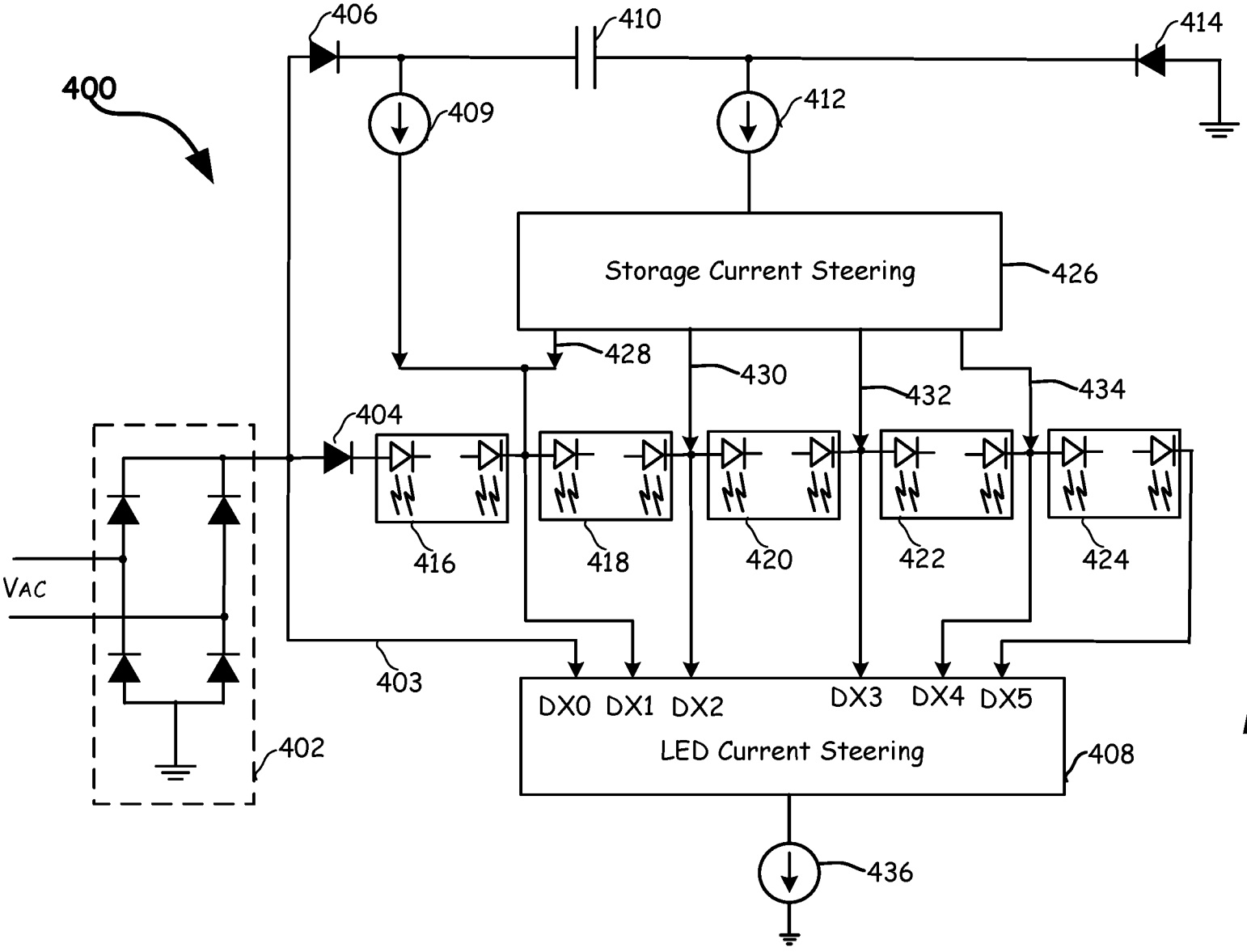
FIG. 4 illustrates a high-level circuit diagram of a first example embodiment of an AC LED driver in accordance with this disclosure.

FIG. 4 illustrates a high-level circuit diagram of a first example embodiment of an AC LED driver in accordance with this disclosure. The first example embodiment couples to a mains AC voltage and drives a plurality of serially-coupled LED strings without first producing a DC voltage supply. The first example embodiment receives the mains AC voltage and rectifies it to produce a rectified AC voltage. This first example embodiment is configured to drive the plurality of serially-coupled LED strings with power derived from the rectified AC voltage. Since the rectified AC voltage continuously changes during the course of an AC power cycle (i.e., not a DC voltage) the brightness of an LED string may vary in accordance with the changing input voltage and current. To reduce or eliminate the varying brightness of the LED string caused by the AC nature of the power supply, the first example embodiment operates to even out the brightness by evening out the power delivered to the LED string. Evening the power delivered to the LED string is done by supplementing the power delivered to the LED string when the rectified AC voltage is too low to provide sufficient power for a desired brightness; and by diverting excess power (i.e., power derived from the rectified AC voltage) to an energy storage circuit when the rectified AC voltage is too high. The stored energy is then available to supplement the power delivered to the LED string when the rectified AC voltage is too low to provide sufficient power to the LED string.

Still referring to FIG. 4, an example AC LED driver circuit 400 includes a bridge rectifier 402. Bridge rectifier 402 is configured to couple to an AC mains voltage source $V_{AC}$. An output node 403 of bridge rectifier 402 is coupled to an anode terminal of a first diode 404, an anode terminal of a second diode 406, and a first input terminal DX0 of LED Current Steering circuit 408. In operation, bridge rectifier 402 provides a rectified AC voltage at output node 403.

A cathode terminal of second diode 406 is coupled to a first current source 409, and further coupled to a first terminal of a (two-terminal) capacitor 410. A second terminal of capacitor 410 is coupled to a first terminal of a second current source 412, and further coupled to a cathode terminal of a third diode 414. As used in this embodiment, capacitor 410 is an energy storage component. In various embodiments, the capacitance of capacitor 410 is chosen to allow the voltage across capacitor 410 to be greater than the average rectified AC voltage at the time when an energy storage cycle is completed. If the capacitance of capacitor 410 is too small, then capacitor 410 will be fully charged before the end of the energy storage cycle, which may result in distortion of LED brightness, and may also result in an undesirable reduction in power factor. If the capacitance of capacitor 410 is too large, then efficiency losses may be incurred during the energy storage cycle, and using a capacitor with a larger than necessary capacitance may increase the cost of the bill of materials. The values and tolerances of various electrical components such as capacitor 410 are discussed in connection with the detailed schematic of FIGS. 8A-8B.

In this example embodiment, an anode terminal of third diode 414 is coupled to ground. Third diode 414 is provided to serve as the current return path during the discharge cycle, i.e., while the energy storage circuit is supplementing the power, derived from the rectified AC voltage, delivered to the LED string.

Still referring to the high-level circuit diagram of the first example embodiment shown in FIG. 4, five LED strings connected in series are provided. In operation the LED strings are used to produce light in an LED lightbulb. In this first example embodiment, a cathode terminal of first diode 404 is coupled to an input terminal of a first LED string 416. An output terminal of first LED string 416 is coupled to an input terminal of a second LED string 418. An output terminal of second LED string 418 is coupled to an input terminal of third LED string 420. An output terminal of third LED string 420 is coupled to an input terminal of a fourth LED string 422. An output terminal of fourth LED string 422 is coupled to an input terminal of a fifth LED string 424. Although the LED strings are illustrated in this example embodiment as all being connected in series, various alternative embodiments may include LED strings in a combination of series and parallel connections. The output terminals of LED strings 416, 418, 420, 422, and 424 are further coupled, respectively, to corresponding input terminals DX1, DX2, DX3, DX4, and DX5 of LED current steering circuit 408. In various alternative embodiments the number of LED strings may be greater than or less than the five LED strings of this example embodiment. In such alternative embodiments, the number of input terminals of current steering circuit 408 would correspondingly increase or decrease. That is, this example embodiment provides each LED string output terminal with a corresponding input terminal of current steering circuit 408 to which it may be coupled. As described in greater detail below in connection with FIG. 6, each of input terminals DXn is coupled to a separate current steering block within LED current steering circuit 408.

Still referring to FIG. 4, example embodiment 400 further includes a storage current steering circuit 426. A first input terminal of storage current steering circuit 426 is coupled to second current source 412. A first output terminal 428 of storage current steering circuit 426 is coupled to the input terminal of second LED string 418. A second output terminal 430 of storage current steering circuit 426 is coupled to the input terminal of third LED string 420. A third output terminal 432 of storage current steering circuit 426 is coupled to the input terminal of fourth LED string 422. A fourth output terminal 434 of storage current steering circuit 426 is coupled to the input terminal of fifth LED string 424. Further, first current source 409 is coupled to the input terminal of second LED string 418. And an output terminal of LED current steering circuit 408 is coupled to third current source 436.

As shown in FIG. 4, storage current steering circuit 426 provides AC LED driver circuit 400 with the pathways to inject current into one or more of the serially-connected LED strings 418, 420, 422, and 424, via output terminals 428, 430, 432, and 434 of storage current steering circuit 426, respectively. Although this configuration provides good efficiency, it adds circuit complexity due to the presence of storage current steering circuit 426.

As discussed above in connection with FIG. 3, when the AC power is greater than the AC Average power, then power (i.e., energy) is stored. And, when the AC power is less than the AC Average power, then power is transferred from an energy storage circuit to the LED strings. Power transferred from the energy storage circuit is in the form of discharge current from the energy storage circuit multiplied by the voltage at which the discharge current is provided. Referring again to FIG. 4, first current source 409 provides the discharge current to the LED strings. First current source 409 provides the LED strings with current in accordance with the following control algorithm: max(0, (AC average current−AC line current)). That is, when the AC line current is greater than the AC average current (which is a time-invariant current) then zero current is provided by first current source 409 to the LED strings. And, when the AC line current is less than the AC Average current through the LED strings, then current is added by first current source 409 such that the AC Average power consumed by the LED strings remains time-invariant. Similarly, second current source 412 operates in accordance with the following control algorithm: max(0, (AC line current−AC Average current)). That is, when the AC Average current is greater than the AC line current then second current source 412 provides zero current. And, when the AC Average current is less than the AC line current then current is provided to the energy storage. The voltage at which the current is supplied to the energy storage determines the magnitude of the stored energy.

Any suitable hardware or hardware/software combination may be used to implement the control algorithms of first current source 409 and second current source 412. For example, a hardware implementation is described below in connection with FIGS. 8A-8B.

Figure 5:
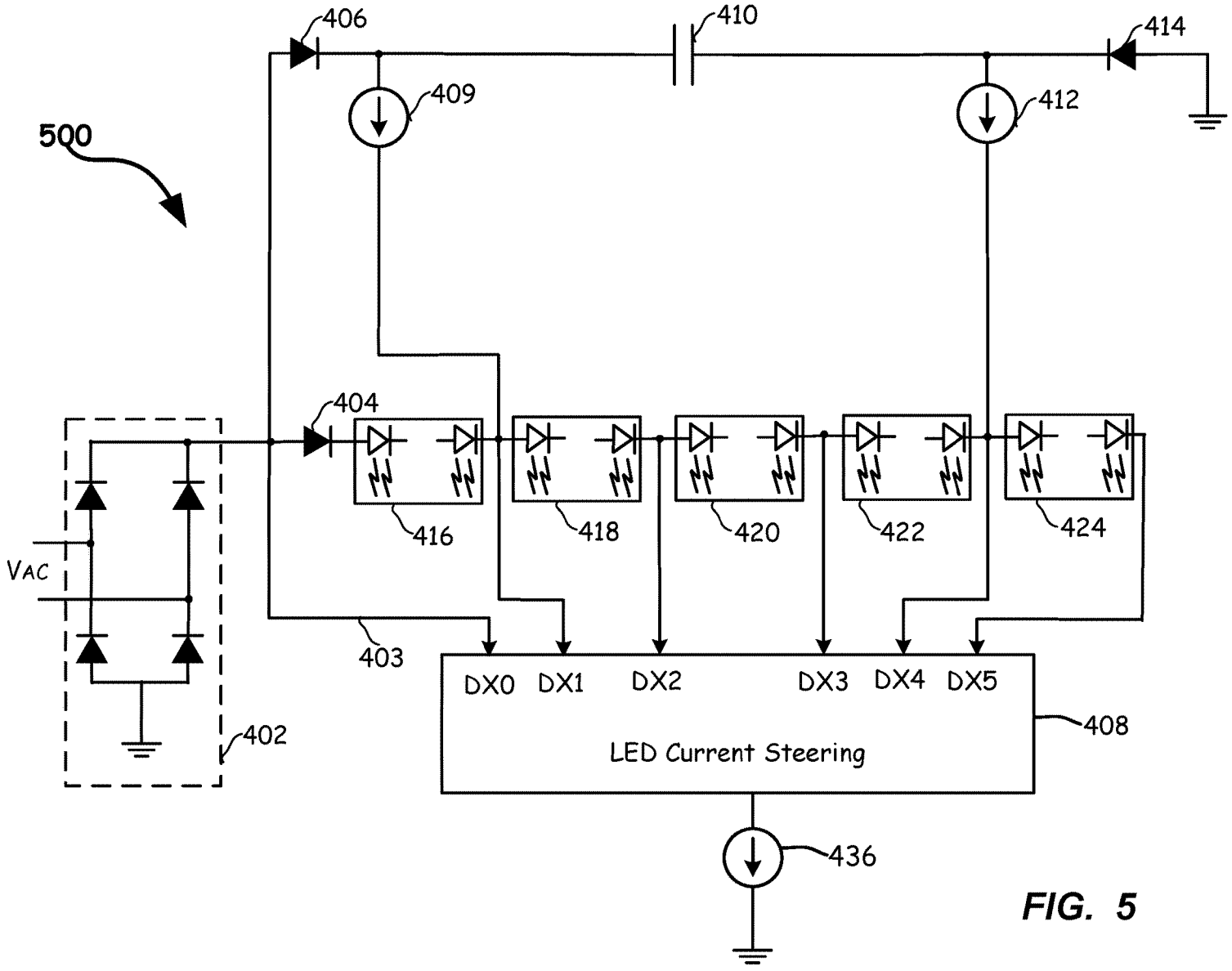
FIG. 5 illustrates a high-level circuit diagram of a second example embodiment of an AC LED driver in accordance with this disclosure.

FIG. 5 illustrates a circuit diagram of a second example embodiment of an AC LED driver in accordance with this disclosure. This second example embodiment is simpler than the first example embodiment of FIG. 4. More specifically, the second embodiment is similar to the first embodiment, except that a storage current steering block, such as storage current steering block 426, is not used. Rather than providing pathways for injection of current into any of the LED string input terminals, the second example embodiment only provides for injection pathways at the input terminals of two LED strings. This approach simplifies the AC LED driver, while still providing near-ideal power factor, and providing LED acceptable brightness matching between the serially-connected LED strings.

Still referring to FIG. 5, an example AC LED driver circuit 500 includes a bridge rectifier 402. Bridge rectifier 402 is configured to couple to an AC mains voltage source $V_{AC}$. An output node 403 of bridge rectifier 402 is coupled to an anode terminal of a first diode 404, an anode terminal of a second diode 406, and a first input terminal DX0 of LED Current Steering circuit 408. In operation, bridge rectifier 402 provides a rectified AC voltage at output node 403.

A cathode terminal of second diode 406 is coupled to a first current source 409, and further coupled to a first terminal of a (two-terminal) capacitor 410. A second terminal of capacitor 410 is coupled to a first terminal of a second current source 412, and further coupled to a cathode terminal of a third diode 414. In this example embodiment, an anode terminal of third diode 414 is coupled to ground. As discussed above in connection with FIG. 4, third diode 414 is provided to serve as the current return path during the discharge cycle, i.e., while the energy storage circuit is supplementing the power, derived from the rectified AC voltage, that is delivered to the LED string.

Still referring to the high-level circuit diagram of the second example embodiment, five LED strings connected in series are provided. In the operation of various embodiments, the LED strings are used to produce light in an LED lightbulb. In this second example embodiment, a cathode terminal of first diode 404 is coupled to an input terminal of a first LED string 416. An output terminal of first LED string 416 is coupled to an input terminal of a second LED string 418. An output terminal of second LED string 418 is coupled to an input terminal of third LED string 420. An output terminal of third LED string 420 is coupled to an input terminal of a fourth LED string 422. An output terminal of fourth LED string 422 is coupled to an input terminal of a fifth LED string 424. The output terminals of LED strings 416, 418, 420, 422, and 424 are further coupled, respectively, to corresponding input terminals DX1, DX2, DX3, DX4, and DX5 of LED current steering circuit 408. In various alternative embodiments the number of LED strings may be greater than or less than the five LED strings of this example embodiment. In such alternative embodiments, the number of input terminals of current steering circuit 408 would correspondingly increase or decrease. That is, this example embodiment provides each LED string output terminal with a corresponding input to current steering circuit 408. As described in greater detail below in connection with FIG. 6, each of inputs DXn is coupled to a separate current steering block within current steering circuit 408.

Still referring to example AC LED driver circuit 500 of FIG. 5, first current source 409 is further coupled to the input terminal of second LED string 418, and second current source 412 is further coupled to input terminal of fifth LED string 424. And an output terminal of LED current steering circuit 408 is coupled to third current source 436.

Figure 6:
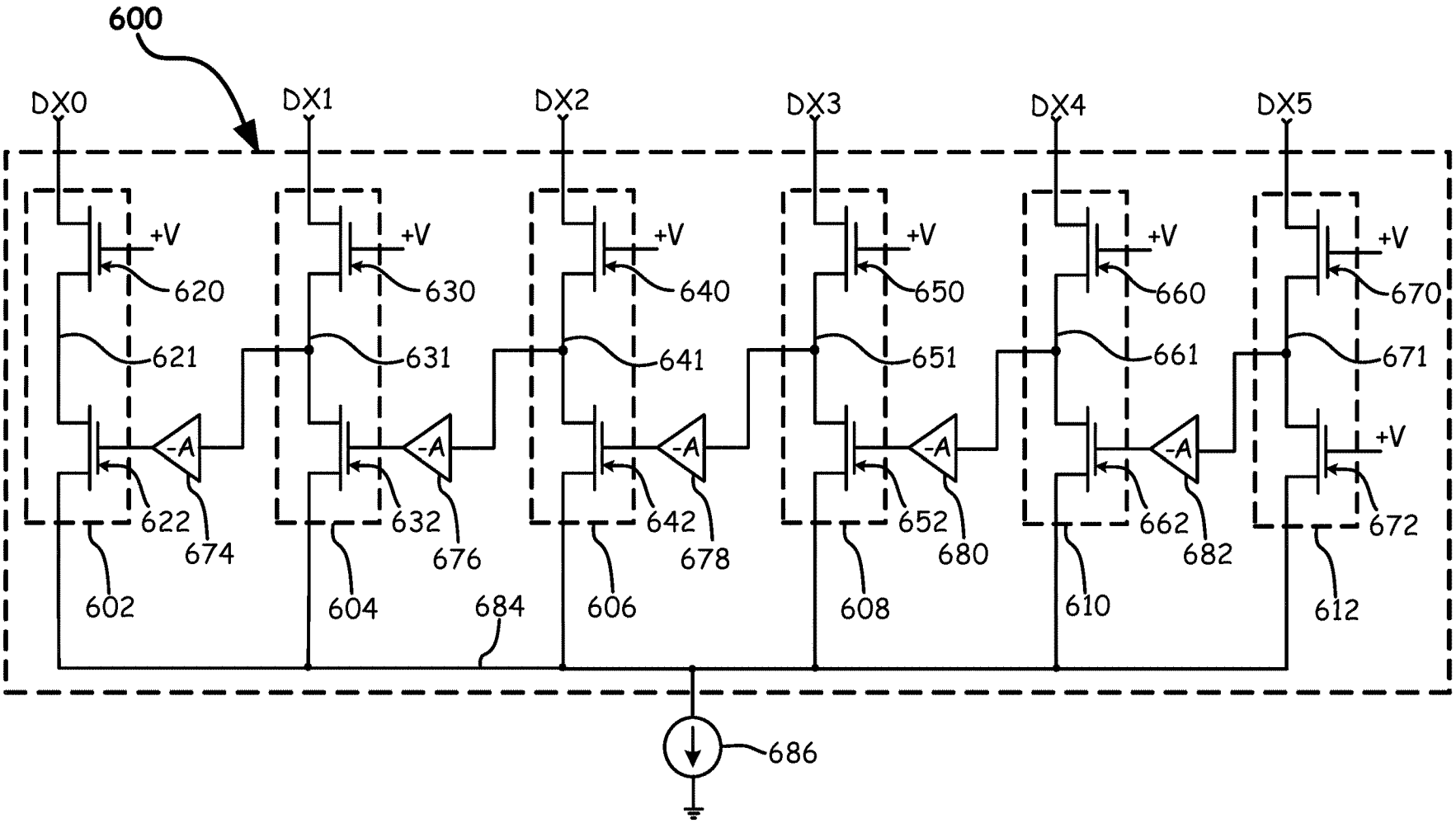
FIG. 6 illustrates a schematic diagram of an example current steering circuit in accordance with embodiments of this disclosure.

FIG. 6 illustrates a schematic diagram of an example current steering circuit in accordance with example embodiments of this disclosure. Example current steering circuit 600 includes a first current steering block 602, a second current steering block 604, a third current steering block 606, a fourth current steering block 608, a fifth current steering block 610, and a sixth current steering block 612. Other functionally equivalent current steering circuitry may be used.

In the embodiment of FIG. 6, each current steering block includes a pair of NFETs in a cascode arrangement. For example, first current steering block 602 includes a first NFET 620 coupled drain-to-source between an input terminal DX0 and an intermediate node 621, and a second NFET 622 coupled in series to intermediate node 621. A gate terminal of first NFET 620 is connected to a positive voltage supply V+. In operation, V+ is greater than a threshold voltage of first NFET 620, so that first NFET 620 is in an on-state.

Each of the second, third, fourth, fifth, and sixth current steering blocks 604, 606, 608, 610, and 612 are constructed similarly to first current steering block 602. That is, each of second, third, fourth, fifth, and sixth current steering blocks 604, 606, 608, 610, and 612, has a pair of NFETs, 630/632, 640/642, 650/652, 660/662, and 670/672, respectively coupled in a cascode arrangement. NFETs 630, 640, 650, 660, and 670 are coupled, respectively, drain-to-source between an input terminal DX1, DX2, DX3, DX4, and DX5, and an intermediate node 631, 641, 651, 661, 671. NFETs 632, 642, 652, 662, and 672 are coupled, respectively, to intermediate nodes 631, 641, 651, 661, and 671. The gate terminals of NFETs 630, 640, 650, 660, and 670 are coupled, respectively, to positive voltage supply V+. In operation, V+ is greater than the threshold voltage of NFET 630, 640, 650, 660, and 670, so that NFETs 630, 640, 650, 660, and 670 are in an on-state.

Still referring to FIG. 6, first current steering block 602 is coupled to second current steering block 604 by an inverting amplifier 674 such that, an input terminal of inverting amplifier 674 is coupled to intermediate node 631, and an output terminal of inverting amplifier 674 is coupled to a gate terminal of NFET 622. Second current steering block 604 is coupled to third current steering block 606 by an inverting amplifier 676 such that, an input terminal of inverting amplifier 676 is coupled to intermediate node 641, and an output terminal of inverting amplifier 676 is coupled to a gate terminal of NFET 632. Third current steering block 606 is coupled to fourth current steering block 608 by an inverting amplifier 678 such that, an input terminal of inverting amplifier 678 is coupled to intermediate node 651, and an output terminal of inverting amplifier 678 is coupled to a gate terminal of NFET 642. Fourth current steering block 608 is coupled to fifth current steering block 610 by an inverting amplifier 680 such that, an input terminal of inverting amplifier 680 is coupled to intermediate node 661, and an output terminal of inverting amplifier 680 is coupled to a gate terminal of NFET 652. Fifth current steering block 610 is coupled to sixth current steering block 612 by an inverting amplifier 682 such that, an input terminal of inverting amplifier 682 is coupled to intermediate node 671, and an output terminal of inverting amplifier 682 is coupled to a gate terminal of NFET 662. The inverting amplifiers act as current flow control circuits and are configured to control the conductivity of the current paths through the current steering blocks.

In the example embodiment of FIG. 6, a source terminal of each of NFETs 622, 632, 642, 652, 662, and 672 is coupled in common to a node 684. Node 684 is coupled to a current source 686. Further, the gate terminal of NFET 672, in sixth current steering block 612, is coupled to positive voltage supply V+. In operation, V+ is greater than the threshold voltage of both NFETs 670 and 672. Thus, in operation, both NFETs 670 and 672 are always in the on-state, and current steering block 612 is always configured to carry current, i.e., the conductivity state is on-state only.

In operation, current steering circuit 600 provides a plurality of switchable (i.e., on-state, or off-state) current paths, and an always-on current path. In an initial state, all of the current paths are in an on-state, that is, they are each ready to conduct current, if any current appears at their respective input terminals. Further, in the initial state, there is no current at the respective input terminals DX1-DX5, and intermediate nodes 631, 641, 651, 661, and 671, are all at a low voltage. When a current appears at input terminal DX1 of current steering block 604, the voltage at node 631 increases resulting in inverting amplifier 674 applying a low voltage to the gate terminal of NFET 622. Consequently, NFET 622 is turned off and first current steering block 602 is thereby switched to the off-state. Similarly, when a current appears at input terminal DX2 of current steering block 606, the voltage at intermediate node 641 increases resulting in inverting amplifier 676 applying a low voltage to the gate terminal of NFET 632. Consequently, NFET 632 is turned off and second current steering block 604 is thereby switched to the off-state. This process continues as current appears sequentially at input terminals DX3, DX4, and DX5. Current steering circuit 600 is an example of a circuit that may be used to achieve the current steering function of current steering circuit 408 shown in FIGS. 4 and 5.

Figure 7:
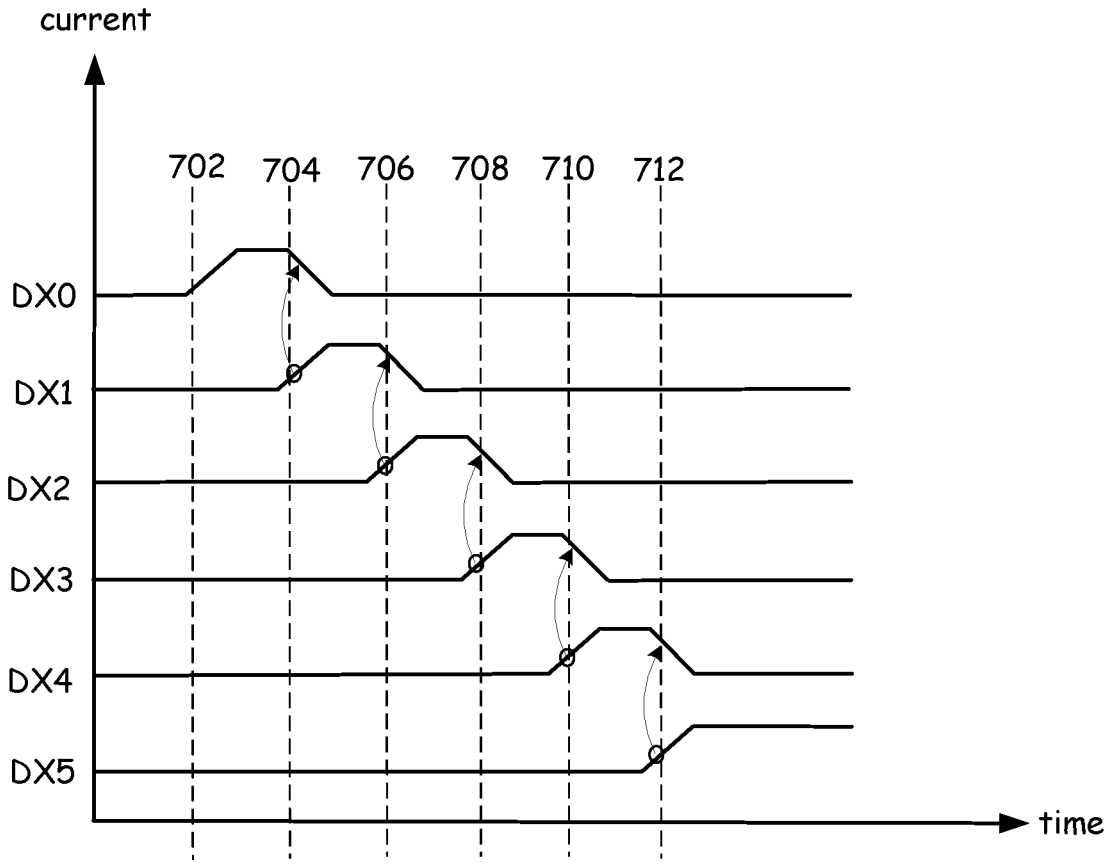
FIG. 7 is a graph illustrating current flow versus time from LED strings to the input terminals of an LED current steering circuit in accordance with embodiments of this disclosure.

FIG. 7 is a graph illustrating a sequence of current flows versus time from LED strings to the input terminals of the LED current steering circuit 600 of FIG. 6 in accordance with embodiments of this disclosure. The graph of FIG. 7 shows the relative times at which each of the current paths through current steering blocks 602, 604, 606, 608, 610 and 612 in the current steering circuit 600 are actually carrying current, which need not be the same as the time periods during which those current paths are in the on-state. Various example embodiments herein have been described with five LED strings and five corresponding input terminals on a current steering circuit. It has been further described herein that a current steering block may have a separate current path coupled to a cathode terminal of each of the serially-connected LED strings. The following description makes reference to the circuit diagrams of FIGS. 4-6.

Prior to powering up, the current steering blocks 602-612 associated with input terminals DX0-DX5 are in the off-state. After power is applied, all the current paths are in the on-state, but beginning at time 702, only the current path associated with input terminal DX0 carries current (e.g., the current path through current steering block 602). Subsequently, the rectified AC voltage increases during the AC power cycle, and the voltage across a first LED string (e.g., first LED string 416) of the serially-connected LED strings reaches its forward voltage and turns on. Current from the first LED string begins to flow through the current steering block associated with input terminal DX1 at time 704 (e.g., current steering block 604). Current flowing through input terminal DX1 triggers the current steering block associated with DX0 to switch to the off-state (as shown by the arrow between the DX0 and DX1 traces in FIG. 7, and as explained above in connection with FIG. 6). As current begins to flow at each successive input terminal DX2, DX3, DX4, and DX5 at, respectively, time 706, 708, 710, and 712, each preceding current steering block is switched to the off-state. In this way, the available current flows through the maximum number of LED strings that the rectified AC voltage can turn on.

Figure 8A:
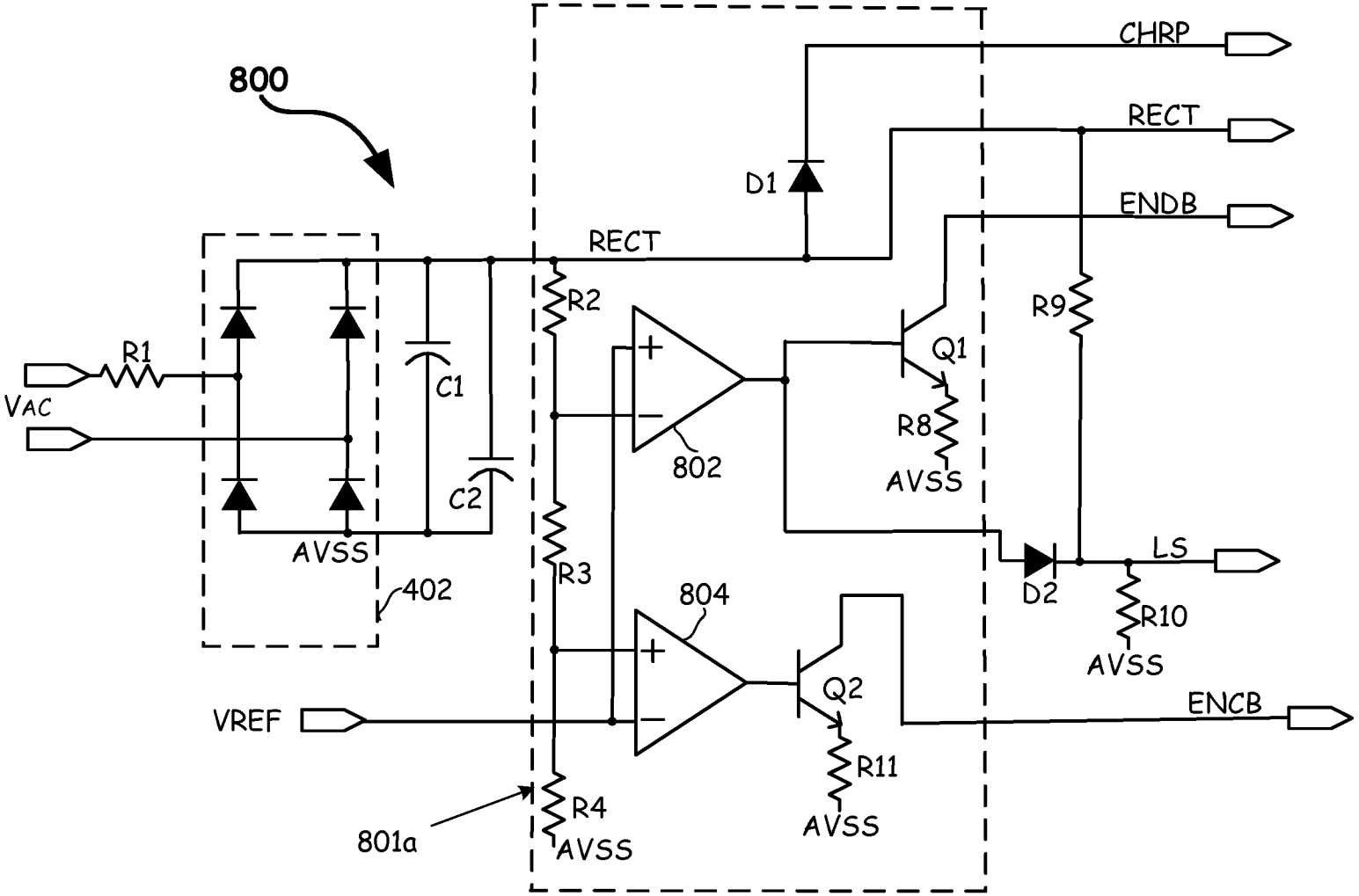
FIG. 8A is a schematic diagram of a first portion of a detailed implementation of the second example embodiment of the AC LED driver of FIG. 5, in accordance with this disclosure.
Figure 8B:
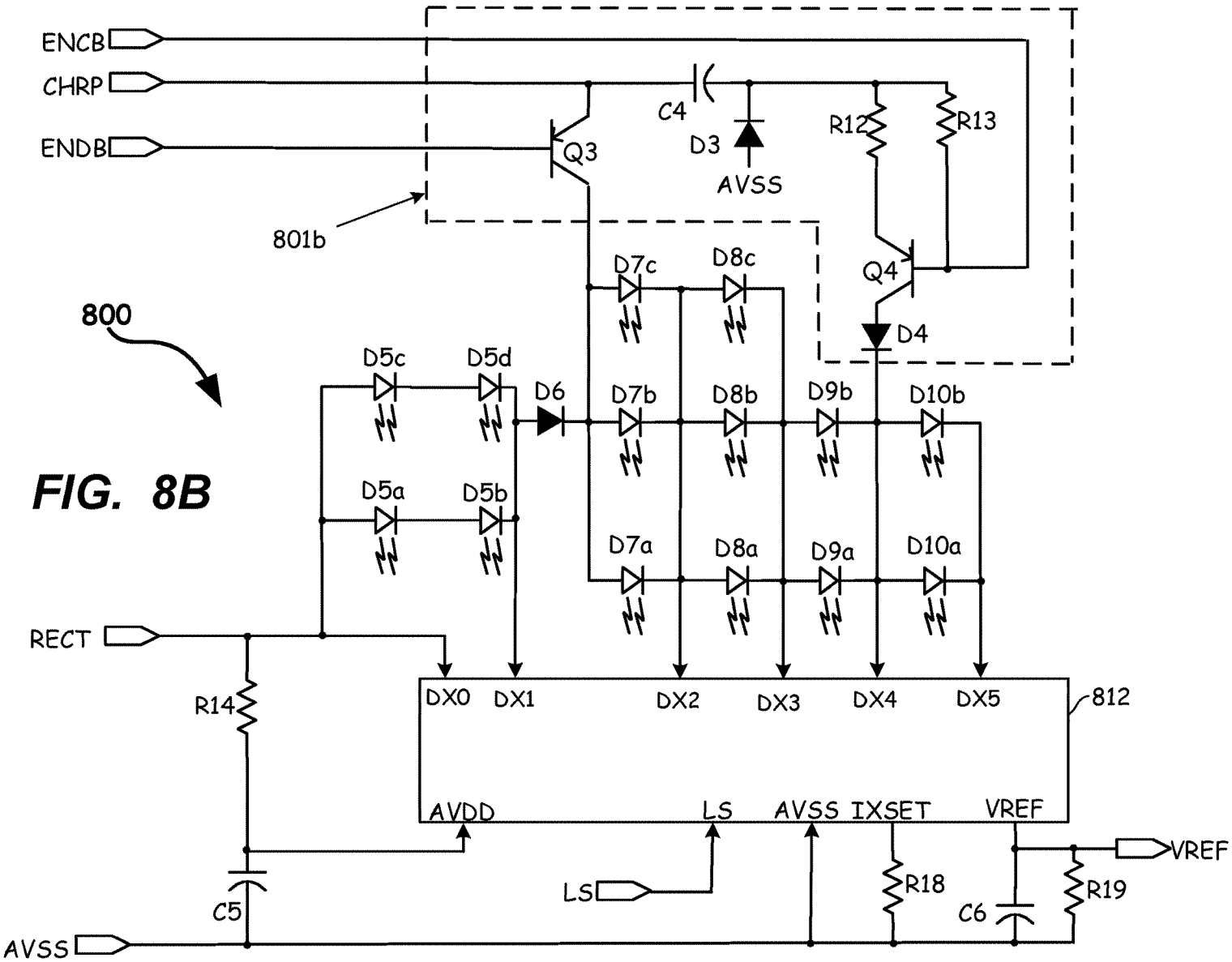
FIG. 8B is a schematic diagram of a second portion of the second example embodiment of the AC LED driver of FIG. 5, in accordance with this disclosure.

FIGS. 8A and 8B are, respectively, first and second portions of a schematic diagram of an example embodiment of the AC LED driver of FIG. 5 in accordance with this disclosure. Together, FIGS. 8A-8B provide a more detailed implementation of the embodiment shown FIG. 5. Various component values, for example, resistance and capacitances are provided in connection with this schematic diagram. It is intended that these component values represent nominal values, that is, these values are not necessarily exact values but rather they are subject to normal variances due to manufacturing tolerances. In this example embodiment, the tolerance for all capacitance values is ±10%, and the tolerance for all resistance values is ±1%. Further, the specific component values provided are not intended to be the only possible set of component values and are merely examples. It is contemplated that there are other sets of component values that may be employed.

FIGS. 8A-8B provide a detailed schematic diagram illustrating an electronic device 800 that implements the high-level circuit diagram of FIG. 5. A first circuit configured to receive an AC power waveform and further configured to provide as an output a rectified AC power waveform is shown as bridge rectifier 402 in FIG. 8A. A second circuit, coupled to the first circuit, configured to receive a portion of the rectified AC power waveform from the first circuit responsive to a magnitude of the rectified AC power waveform being greater than a magnitude of the AC Average Power, and further configured to provide power responsive to the rectified AC power waveform being less than the magnitude of the Average AC Power is shown as the circuitry in blocks 801*a* and 801*b*. The circuitry in blocks 801*a* and 801*b* correspond to the energy storage circuit including the circuitry that implements the control algorithms for charging and discharging of the energy storage circuit. A third circuit having a plurality of current paths, the third circuit coupled to the first circuit, the second circuit, and the plurality of LED strings, is shown as a current steering circuit.

Referring to FIG. 8A, electronic device 800 includes a bridge rectifier 402 having a rectified AC voltage as an output, referred to as RECT. The two input terminals of bridge rectifier 402 are coupled to the AC mains voltage, referred to $V_{AC}$. A first resistor, R1, is coupled in series between the $V_{AC}$ and one of the input terminals of bridge rectifier 402. In this example embodiment, $V_{AC}$ is 120 volts AC, and R1 is rated as a half-watt resistor. A first capacitor C1, and a second capacitor C2 are each coupled between RECT and an analog ground node AVSS. In some embodiments, C1 and C2 each have a capacitance of 0.01 ρF. As noted above, capacitance values and resistance values in the various example embodiments disclosed herein have tolerances, respectively, of ±10% and ±1%. The anode of a first diode, D1, is connected to RECT, and the cathode of diode D1 is referred as CHRP. A second resistor, R2, a third resistor, R3, and a fourth resistor R4, are connected in series between RECT and AVSS. In this example embodiment, R2 may have a resistance of 249 KΩ, R3 may have a resistance of 3.321 KΩ, and R4 may have a resistance of 2.67 KΩ. Other resistance values may be used. A first amplifier 802, and a second amplifier 804, are provided, each of amplifiers 802 and 804, having both inverting (−) and non-inverting (+) input terminals. The non-inverting input terminal of first amplifier 802, and the inverting input terminal of second amplifier 804 are connected in common with a control signal referred to as VREF. The inverting input terminal of first amplifier 802 is connected to a common node between serially-connected resistors R2 and R3. The non-inverting input terminal of second amplifier 804 is connected to a common node between serially-connected resistors R3 and R4.

Still referring to FIG. 8A, an output terminal of first amplifier 802 is coupled to the anode of a diode D2, and to the base of NPN transistor Q1. A resistor R8 is coupled between the emitter of NPN transistor Q1 and AVSS. The collector of NPN transistor Q1 is connected to a node labelled ENDB. The signal on node ENDB, when asserted, enables discharge of stored energy to supplement power concurrently derived from the rectified AC voltage. A resistor R9 and a resistor R10 are serially connected between RECT and AVSS. The cathode of diode D2 is coupled to a common node between resistors R9 and R10. In this example embodiment, resistors R8, R9, and R10 may have, respectively, resistances of 3 KΩ, 750 KΩ, and 21.5 KΩ. Other resistance values may be used. An output terminal of second amplifier 804 is coupled to the base of NPN transistor Q2. A resistor R11 is coupled between the emitter of NPN transistor Q2 and AVSS. In some embodiments, resistor R11 may have a resistance of 4.99 KΩ. The collector of NPN transistor Q2 is connected to a node labelled ENCB. The signal on node ENCB, when asserted, enables charging of the energy storage circuit, which in this example is a capacitor.

Still referring to FIG. 8A, the cathode of diode D2 is coupled to a node referred to as LS.

Referring to FIG. 8B, a PNP transistor Q3 has a base terminal coupled to node ENDB, and an emitter terminal coupled to node CHRP. PNP transistor Q3 corresponds to first current source 409 shown in FIGS. 4 and 5. In operation, the voltage at node ENDB goes low to enable the discharge of capacitor C4. A first terminal of a capacitor C4 is coupled to node CHRP, and, in some embodiments, may have a capacitance of 2.2 μF, although other embodiments may use other values of capacitance. Node CHRP provides charging voltage/current to capacitor C4. Capacitor C4 is an energy storage component, and corresponds to capacitor 410 in FIGS. 4 and 5. If the capacitance of C4 is too small the capacitor will be completely charged before the AC line current is equal to AC average current, i.e., at the end of the energy storage cycle. This in turn will cause distortion thereby reducing the flicker. If the capacitance of C4 is too large then efficiency losses may be incurred during the charge cycle. A second terminal of capacitor C4 is coupled to the cathode of a diode D3. The cathode of diode D3 is further coupled to a first terminal of a resistor R12, and to a first terminal of a resistor R13. The anode of diode D3 is coupled to AVSS. Diode D3 may be used for current return path during discharge of capacitor C4. In some embodiments, resistors R12 and R13 may have, respectively, resistances of 17.4Ω and 1.5 KΩ. A PNP transistor Q4 has an emitter terminal coupled to a second terminal of resistor R12, a base terminal coupled to a second terminal of resistor R13 and further coupled to ENCB, and a collector terminal coupled to the anode of a diode D4. PNP transistor Q4 corresponds to second current source 412 in FIGS. 4 and 5.

Still referring to the schematic diagram of FIG. 8B, a number of LED strings are shown. In FIG. 8B, LED strings may be represented schematically by a single LED schematic symbol. It is understood that an LED string may comprise one or more individual LEDs. Two or more LED strings may be grouped in parallel, and such parallel groupings may, in turn, be serially connected. In this illustrative embodiment, the LED strings may be part number SAW8KG0B manufactured by Seoul Semiconductor, or the equivalent. LEDs D5*a*-D5*d*, collectively, correspond to first LED string 416 of FIGS. 4 and 5. LEDs D7*a*-D7*c* correspond to second LED string 418 of FIGS. 4 and 5. LEDs D8*a*-D8*c* correspond to third LED string 420 of FIGS. 4 and 5. LEDs D9*a*-D9*b* correspond to fourth LED string 422 of FIGS. 4 and 5. LEDs D10*a*-D10*b* correspond to fifth LED string 424 of FIGS. 4 and 5. Taken together, LED strings 416-424 correspond to a plurality of LED strings coupled to each other in series.

The LEDs D5*a* and D5*b*, are coupled in parallel with serially-connected LED strings D5*c* and D5*d*, between the node RECT and the anode of a diode D6. The cathode of diode D6 is coupled to a collector terminal of PNP transistor Q3, and to the anodes of LED strings D7*a*, D7*b*, and D7*c*. The cathodes, respectively, of LED strings D7*a*, D7*b*, and D7*c* are coupled, respectively, to the anodes of LED strings D8*a*, D8*b*, and D8*c*. The cathodes of LED strings D8*a*, and D8*b*, are respectively coupled to the anodes of LED strings D9*a*, and D9*b*. The cathodes of LED strings D9*a*, and D9*b*, are respectively coupled to the anodes of LED strings D10*a*, and D10*b*. Additionally, the cathodes of LED strings D5*b* and D5*d* are coupled to an input terminal DX1 of a current steering circuit 812. The cathodes of LED strings D7*a*, D7*b*, and D7*c* are coupled to an input terminal DX2 of current steering circuit 812. The cathodes of LED strings D8*a*, D8*b*, and D8*c* are coupled to an input terminal DX3 of current steering circuit 812. The cathodes of LED strings D9*a*, and D9*b* are coupled to an input terminal DX4 of current steering circuit 812. The cathodes of LED strings D10*a*, and D10*b* are coupled to an input terminal DX5 of current steering circuit 812. The node RECT is coupled to an input terminal DX0 of current steering circuit 812.

Current steering circuit 812 is similar to current steering circuit 600 of FIG. 6, and may include some additional circuitry. In the example embodiment of FIGS. 8A-8B, current steering circuit 812 incorporates the same current steering circuitry illustrated in FIG. 6, including current source 686. Current steering circuit 812 further includes inputs IXSET and LS. The signals IXSET and LS are used by current steering circuit 812 to set the main current level of current source 686. Providing designers with input signals IXSET and LS to set the main current level for current source 686, allows the use of, for example, dimming control signals to reduce the current through current source 686 and thereby dim the brightness of the LED strings coupled to current steering circuit 812. Additionally, current steering circuit 812 may include a voltage reference circuit, such as, for example, a band-gap voltage reference circuit configured to output a voltage signal VREF. Current steering circuit 812 is available from iSine, Inc. of Boston, Mass., as a stand-alone integrated circuit having the part number S006B.

Still referring to FIG. 8B, in some embodiments, the voltage on power supply rail AVDD may be generated by a resistor and a capacitor. For example resistor R14, may be coupled in series between the node RECT (on which the rectified AC voltage appears) and a first terminal of capacitor C5. A second terminal of capacitor C5 is coupled to node AVSS (the analog ground node). The common node between R14 and C5 is coupled to positive power rail AVDD. Capacitor C5 may have a capacitance of 10 μF in some embodiments, although other values may be used. AVDD is shown coupled to current steering circuit 812 to provide power thereto. A resistor R18 is provided between an IXSET input terminal of current steering circuit 812 and AVSS. A capacitor C6 in parallel with a resistor R19 are coupled between a VREF terminal of current steering circuit 812 and AVSS.

Figure 9:
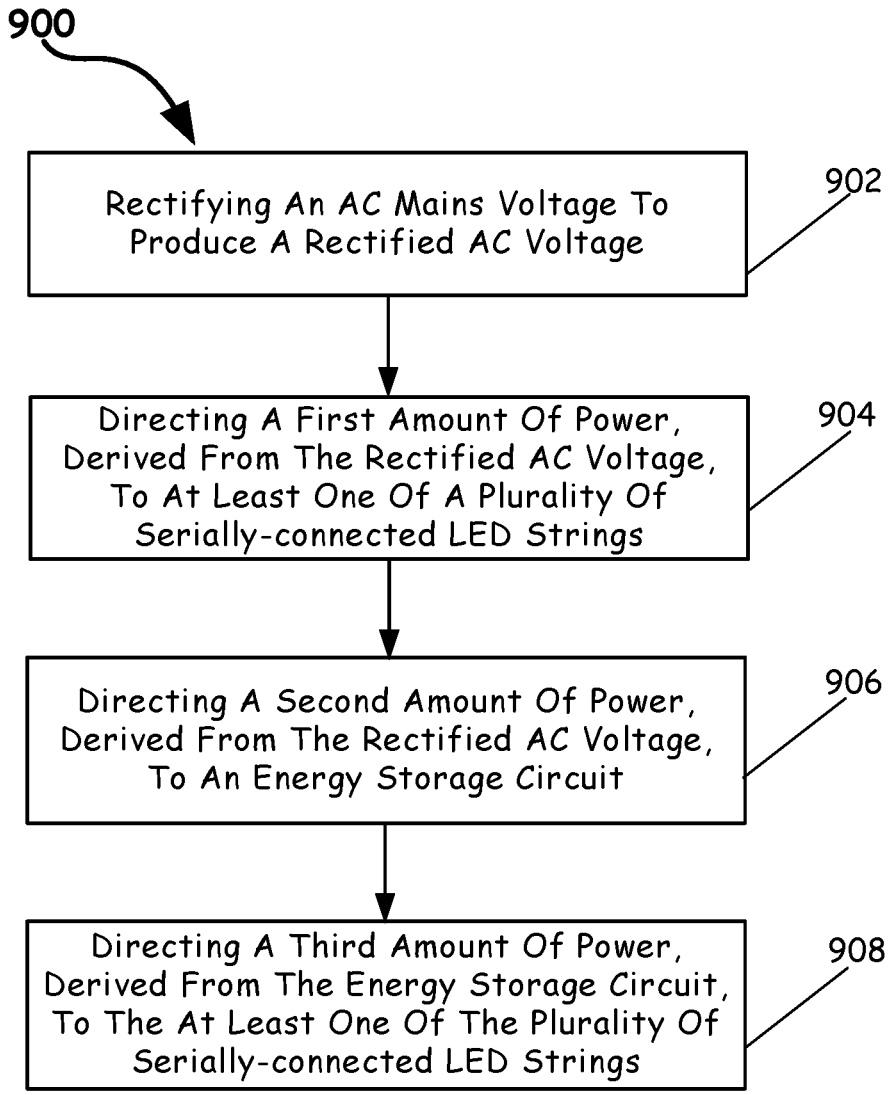
FIG. 9 is a flow diagram of a method of operating an LED light bulb in accordance with embodiments this disclosure.

FIG. 9 is a flow diagram of a method of operating an LED lightbulb in accordance with this disclosure. A method 900 provides for a substantially constant, amount of power to be consumed by the LED strings in the LED lightbulb without generating a DC supply voltage. A method 900 of operating an LED lightbulb includes rectifying 902 an AC mains voltage to produce a rectified AC voltage, and directing 904 a first amount of power derived from the rectified AC voltage to at least one of a plurality of serially-connected LED strings. Rectifying the AC mains voltage may be achieved by any suitable methods or circuits, including but not limited to, applying the AC mains voltage to a bridge rectifier (e.g., bridge rectifier 402 of FIGS. 4, 5, and 8A). By utilizing the rectified AC voltage to power LED strings within the LED lightbulb, in accordance with this disclosure, it is unnecessary to generate a DC voltage by an LED driver circuit. Method 900 further includes directing 906 a second amount of power derived from the rectified AC voltage to an energy storage circuit. An energy storage circuit may be based on storing charge on a capacitor, or alternatively storing a magnetic field on an inductor. For example, energy is stored on capacitor 410 in FIGS. 4-5, and on capacitor C4 in FIG. 8B. Method 900 further includes directing 908 a third amount of power derived from the energy storage circuit to the at least one of the plurality of serially-connected LED strings. For example, power is delivered from the energy storage circuit by means of first current source 409 in FIGS. 4-5, and by current source Q3 in FIG.

8B. By storing energy when the magnitude of the rectified AC power is greater than a predetermined power magnitude, and providing power from the stored energy when the magnitude of the rectified AC power is less than the predetermined power magnitude, a substantially constant amount of power is consumed by the plurality of LED strings, thus reducing or eliminating variations in brightness otherwise caused by an AC power source.

Because the power consumed by the plurality of serially-connected LED strings, in accordance with this disclosure, is nominally or substantially constant, the flicker percent and the flicker index are reduced or eliminated. That is, the power used for light output is nominally constant and therefore the light output is nominally independent of changes in AC power. For example, in some embodiments, the power delivered and/or consumed by the LED strings may be maintained within a predetermined target power level. Thus flicker index values less than 20% may be achieved. In this way, various embodiments in accordance with this disclosure may meet all industry standards for flicker percentage and flicker index.

TERMINOLOGY

Figure 10:
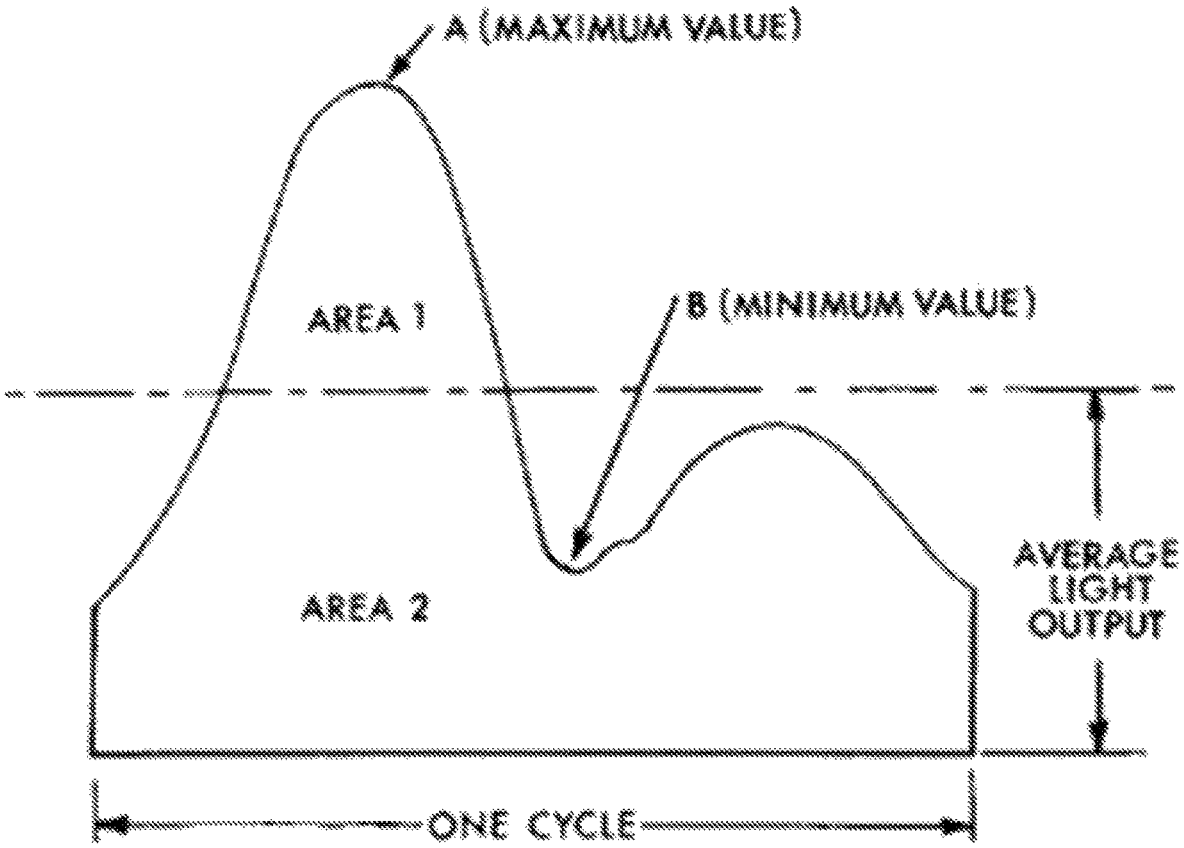
FIG. 10 is a graph of time-varying light output during a single AC power cycle, used to define flicker index and flicker percent in accordance with embodiments of this disclosure.

Flicker index, as used herein, is defined to be a measure of the cyclic variation in output of a light source, taking into account the waveform of the light output. It is the ratio of the area under a light output curve that is above an average light output level to the total area under the light output curve for a single AC cycle. FIG. 10 provides an example illustration of a light output curve for a hypothetical light source over a single AC cycle, and shows the average light output over that cycle, as well as the maximum and minimum of the light output over that cycle).

Flicker percent is defined by the Illuminating Engineer Society to be a relative measure of the cycle variation in output of light source (percent modulation). It is given by the expression 100(A−B)/(A+B), where A is the maximum and B is the minimum output during a single cycle, and is expressed as a percentage. (See FIG. 10.)

Power, as used herein, refers to electrical power in the units of watts, and is defined as the product of current multiplied by voltage, i.e., watts=amps×volts. In the International System of Units (SI), 1 watt=1 joule/sec.

Energy, as used herein, refers to electrical energy in units of kilowatt-hours, and is defined as Energy=watts×hours, or Energy=amps×volts×hours. In the International System of Units electrical energy is measured in joules. One kilowatt-hour=$3.6\times10^6$ joules. Unlike power, energy can be stored.

Historically, power factor has referred to the ratio of the real power to the apparent power (a number between 0 and 1, and commonly expressed as a percentage). Real power is the capacity of a circuit to perform work in a particular time. Apparent power is the product of the current and voltage in the circuit, and consists of real power plus reactive power. Due to either energy stored in the load and returned to the source, or to a non-linear load that distorts the wave shape of the current drawn from the source, the apparent power can be greater than the real power. More recently, power factor has come to be defined as:

$$\frac{\cos\theta}{\sqrt{1+THD^2}} \tag{1}$$

where θ is the phase shift from real power, and THD is the total harmonic distortion of the first fifteen harmonics. Low power factor loads increase losses in a power generation system and consequently increases energy costs.

Power factor correction refers to a technique of counteracting the undesirable effects of electric circuits that create a power factor that is less than one.

The acronym "RMS" refers to root mean square.

In the case of a single LED, $V_f$ refers to the forward-bias voltage of that single LED. In the case of an LED string, $V_f$ refers to the forward-bias voltage summed across that string of LEDs.

The term "lamp," refers generally to a man-made source created to produce optical radiation. By extension, the term is also used to denote sources that radiate in regions of the spectrum adjacent to the visible. LED-based light bulbs may also be referred to as LED lamps. An LED-based light bulb includes a housing within which the LEDs and associated circuits are disposed.

The term "luminaire," refers generally to a light fixture, and more particularly refers to a complete lighting unit that includes lamp(s) and ballast(s) (when applicable) together with the parts designed to distribute the light, position and protect the lamp(s), and to connect the lamp(s) to the power supply.

The expression "LED luminaire," refers to a complete lighting unit that includes LED-based light emitting elements (described below) and a matched driver together with parts to distribute light, to position and protect the light emitting elements, and to connect the unit to a branch circuit or other overcurrent protector. The LED-based light emitting elements may take the form of LED packages (components), LED arrays (modules), an LED Light Engine, or LED lamps. An LED luminaire is intended to connect directly to a branch circuit.

The expression "Solid State Lighting" (SSL) refers to the fact that the light is emitted from a solid object a block of semiconductor rather than from a vacuum or gas tube, as in the case of incandescent and fluorescent lighting. There are at least two types of solid-state light emitters, including inorganic light-emitting diodes (LEDs) and organic light-emitting diodes (OLEDs).

"Electrolytic capacitor" refers to a polarized capacitor.

"Ceramic capacitor" refers to a capacitor having a ceramic dielectric layer.

"Film capacitor" refers to a capacitor having a plastic or similar film dielectric layer.

The term "FET," as used herein, refers to metal-oxide-semiconductor field effect transistors (MOSFETs). These transistors are also known as insulated gate field effect transistors (IGFETs). An n-channel FET is referred to as an NFET. A p-channel FET is referred to as a PFET. A FET has a first source/drain terminal, a second source/drain terminal, and a gate terminal. A voltage applied to the gate terminal controls whether the FET is "on" or "off." When the voltage applied to the gate terminal puts the FET into the "on" state, conduction between the first source/drain terminal and the second source/drain terminal may take place.

Source/drain (S/D) terminals refer to the terminals of a FET, between which conduction occurs under the influence of an electric field resulting from a voltage applied to the gate terminal. Generally, the source and drain terminals of FETs used for logic applications are fabricated such that they are geometrically symmetrical. However, it is common that the source and drain terminals of power FETs are fabricated with asymmetrical geometries. With geometrically symmetrical source and drain terminals it is common to simply refer to these terminals as source/drain terminals, and this nomenclature is used herein. Designers may designate a particular source/drain terminal to be a "source" or a "drain" on the basis of the voltage to be applied to that terminal when the FET is operated in a circuit.

The term "mains" refers to a branch circuit of a main AC electrical power supply, for example, wiring that conducts AC voltage and current from/to an electrical breaker panel, where that breaker panel is coupled to an electrical power grid.

The expression "mains AC voltage," as used herein, refers to an unrectified, sinusoidal AC voltage supplied to a branch circuit by a breaker panel.

The term "nominal," as used herein, refers to a desired, or target, value of a characteristic or parameter for a component or a signal, set during the design phase of a product, together with a range of values above and/or below the desired, or target, value. The range of values is typically due to slight variations in manufacturing processes or tolerances. By way of example and not limitation, a resistor may be specified as having a nominal value of 10 KΩ, which would be understood to mean 10 KΩ plus or minus a certain percentage (e.g., ±5%) of the specified value.

With respect to the various circuits, sub-circuits, and electrical circuit elements described herein, signals are coupled between them and other circuit elements via physical, electrically conductive connections. It is noted that, in this field, the point of connection is sometimes referred to as an input, output, input/output (I/O), terminal, line, pin, pad, port, interface, node, or similar variants and combinations.

The foregoing disclosure outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the subjoined claims.

What is claimed is:

1. An electronic device, comprising:

a plurality of light emitting diode (LED) strings coupled to each other in series;

a voltage reference circuit having an output terminal, and configured to generate a reference voltage;

a first circuit configured to receive an AC power waveform and further configured to provide as an output a rectified AC power waveform at a first circuit output terminal;

a second circuit coupled to the first circuit, the second circuit comprising:

a voltage divider having a voltage divider first output terminal and a voltage divider second output terminal, the voltage divider configured to receive the rectified AC Power waveform from the first circuit output terminal, and further configured to provide a first voltage at the voltage divider first output terminal, and provide a second voltage at the voltage divider second output terminal, a first amplifier having a non-inverting input terminal coupled to the output terminal of the voltage reference circuit, and having an inverting input terminal coupled to the voltage divider first output terminal, and a second amplifier having a non-inverting input terminal coupled to the voltage divider second output terminal, and having an inverting input terminal coupled to the output terminal of the voltage reference circuit;

a third circuit having a plurality of current paths, the third circuit coupled to the first circuit, the second circuit, and the plurality of LED strings, wherein at least one LED string of the plurality of LED strings is coupled to the first circuit and the second circuit, and each current path of the third circuit is configured to have a conductivity state including at least one of an on-state and an off-state, the second circuit is configured to receive a portion of the rectified AC power waveform responsive to the second voltage at the non-inverting terminal of the second amplifier being greater than the reference voltage at the inverting terminal of the second amplifier, and the second voltage is linearly-related to the rectified AC power waveform.

2. The electronic device of claim 1, wherein the second circuit is further configured to provide energy to at least one LED string of the plurality of LED strings responsive to the first voltage at the inverting input terminal of the first amplifier, and the first voltage is linearly-related to the rectified AC power waveform.

3. The electronic device of claim 2, wherein the second circuit is at least further configured to store energy.

4. The electronic device of claim 1, wherein the second circuit includes an energy storage component.

5. The electronic device of claim 4, wherein the energy storage component is a capacitor.

6. The electronic device of claim 1, further comprising a current source coupled between the third circuit and a ground node.

7. The electronic device of claim 1, wherein the third circuit further includes current flow control circuits configured to control the conductivity state of at least some of the current paths.

8. The electronic device of claim 1, wherein at least one of the current paths has an always on conductivity state.

9. A light emitting diode (LED) light bulb, comprising:

a housing, at least a portion of which is optically transmissive;

a screwbase coupled to the housing; and an electronic device disposed within the housing, the electronic device comprising:

a plurality of light emitting diode (LED) strings coupled to each other in series;

a first circuit configured to receive an AC power waveform and further configured to provide as an output a rectified AC power waveform;

a second circuit, coupled to the first circuit, configured to receive a portion of the rectified AC power waveform from the first circuit responsive to the rectified AC power waveform being greater than an AC Average Power, and further configured to provide power responsive to the rectified AC power waveform being less than the AC Average Power;

a voltage reference circuit coupled to the second circuit; and a third circuit having a plurality of current paths, the third circuit coupled to the first circuit, the second circuit, and the plurality of LED strings, wherein at least one LED string of the plurality of LED strings is coupled to the first circuit and the second circuit, and each current path of the third circuit is configured to have a conductivity state including at least one of an on-state and an off-state, and wherein the second circuit comprises circuitry configured to assert a first signal responsive to the rectified AC power waveform being greater than the AC Average Power; and further configured to assert a second signal responsive to the rectified AC power waveform being less than the AC Average Power.

10. The LED light bulb of claim 9, wherein the electronic device is electrically coupled to the screwbase, and the screwbase is configured to engage with a lightbulb socket.

11. The LED light bulb of claim 9, wherein the second circuit is at least configured to store energy.

12. The LED light bulb of claim 9, wherein the second circuit includes an energy storage component.

13. The LED light bulb of claim 12, wherein the energy storage component is a capacitor.

14. The LED light bulb of claim 9, wherein the first circuit comprises a bridge rectifier.

15. The LED light bulb of claim 9, wherein the third circuit further includes current flow control circuits configured to control the conductivity state of at least some of the current paths.

16. A method of operating a light emitting diode (LED) light bulb, comprising:

rectifying an AC mains voltage to produce a rectified AC voltage;

generating a reference voltage, a first voltage linearly related to the rectified AC voltage, and a second voltage linearly related to the rectified AC voltage, wherein the second voltage is less than the first voltage;

asserting a charge-enable signal responsive to the second voltage being greater than the reference voltage;

asserting a discharge-enable signal responsive to the reference voltage being greater than the first voltage;

directing a first amount of power, derived from the rectified AC voltage, to at least one of a plurality of serially-connected LED strings;

directing a second amount of power, derived from the rectified AC voltage, to an energy storage circuit, responsive to the asserting of the charge-enable signal; and directing a third amount of power, derived from the energy storage circuit, to the at least one of the plurality of serially-connected LED strings responsive to the asserting of the discharge-enable signal, wherein the first amount of power is a first time-varying amount, the second amount of power is a second time-varying amount, the third amount of power is a third time-varying amount, and a flicker index is less than 20%.

17. The method of claim 16, wherein the second amount of power is zero when the first amount of power is less than a predetermined magnitude, and the third amount of power is zero when the first amount of power is greater than the predetermined magnitude.

18. The electronic device of claim 1, wherein the voltage reference circuit is a band-gap voltage reference circuit.

19. The electronic device of claim 1, wherein the first amplifier has an output terminal and the second amplifier has an output terminal, the output terminal of the first amplifier is coupled to a base of a first transistor, and the output terminal of the second amplifier is coupled to a base of a second transistor.

20. The LED light bulb of claim 9, wherein the voltage reference circuit is a band-gap voltage reference circuit.

* * * * *